United States Patent [19]

Ortmann et al.

[11] Patent Number: 4,941,244

[45] Date of Patent: Jul. 17, 1990

[54] METHOD OF PRODUCING DISCARDING SABOT PROJECTILES

[75] Inventors: Helmut Ortmann, Duisburg; Rolf Scharnhorst, Dusseldorf, both of Fed. Rep. of Germany

[73] Assignee: Rheinmetall GmbH, Dusseldorf, Fed. Rep. of Germany

[21] Appl. No.: 240,589

[22] Filed: Sep. 6, 1988

[30] Foreign Application Priority Data

Sep. 10, 1987 [DE] Fed. Rep. of Germany ..... 3730370

[51] Int. Cl.[5] ..... B21K 21/06

[52] U.S. Cl. ..... 29/1.2; 29/450; 29/453; 29/460; 102/521; 264/263; 264/276; 264/328.9

[58] Field of Search ..... 29/1.2, 1.21, 1.22, 29/1.23, 450, 453, 460; 102/521, 522, 523; 264/263, 276, 328.9

[56] References Cited

U.S. PATENT DOCUMENTS

| | | | |
|---|---|---|---|
| H265 | 5/1987 | Bonde et al. | 102/521 |
| 3,518,339 | 6/1970 | Goff | 29/460 X |
| 3,620,167 | 11/1971 | Romer et al. | 102/521 |
| 4,351,094 | 9/1982 | Häberli | 29/1.2 |
| 4,372,217 | 2/1983 | Kirkendall et al. | 102/521 |
| 4,444,113 | 4/1984 | Campoli | 102/521 X |
| 4,444,114 | 4/1984 | Bisping et al. | 102/430 |
| 4,459,894 | 7/1984 | Bunch | 102/521 X |
| 4,467,724 | 8/1984 | Marlow | 102/520 |
| 4,487,131 | 12/1984 | Luther | 102/523 |
| 4,542,696 | 9/1985 | Bisping et al. | 102/430 |
| 4,651,649 | 3/1987 | Nussbaum | 102/521 |
| 4,735,148 | 4/1988 | Holtzman et al. | 102/522 |
| 4,802,415 | 2/1989 | Clarke et al. | 102/521 X |
| 4,815,682 | 3/1989 | Feldmann et al. | 102/521 X |

FOREIGN PATENT DOCUMENTS

| | | | |
|---|---|---|---|
| 0049329 | 7/1981 | European Pat. Off. . | |
| 1703507 | 3/1972 | Fed. Rep. of Germany | 102/521 |
| 2836963 | 3/1984 | Fed. Rep. of Germany | 102/430 |
| 3332675 | 3/1985 | Fed. Rep. of Germany . | |

*Primary Examiner*—Timothy V. Eley
*Assistant Examiner*—Frances Chin
*Attorney, Agent, or Firm*—Spencer & Frank

[57] ABSTRACT

A method of producing a discarding propelling cage sabot projectile, and to a discarding propelling cage sabot projectile produced according to this method, in which, in a vulcanizing tool including an injection mold, a uniformly thin layer of rubber is applied to the rear gas pressure receiving surface of the sabot so as to secure and seal the individual sabot segments against one another. In such a method, when the liquid sealing material is injected into the injection mold, there exists the danger that, due to the high pressure existing at that time, sealing material may enter, in an uncontrolling manner, into the cylindrical inner annular gap or annulus between the sabot and the projectile body. This may considerably adversely influence the release behavior of the discarding sabot segments and lead to a reduction of hit accuracy. This drawback is overcome according to the invention, in that, before the discarding sabot projectile is inserted into the vulcanizing tool, the rear annular gap or annulus between the sabot and the projectile body is sealed by the application of a sealing means, e.g., a sealing ring, to the circumference of the projectile body.

7 Claims, 2 Drawing Sheets

METHOD OF PRODUCING DISCARDING SABOT PROJECTILES

BACKGROUND OF THE INVENTION

The present invention relates to an improved method of producing a discarding sabot projectile in which the individual sabot segments are secured and sealed against one another in a vulcanizing tool including an injection mold in that a thin layer or coating of caoutchouc or rubber is sprayed onto the rear gas pressure receiving surface of the discardable sabot and is vulcanized. The invention also relates to the discarding sabot projectile produced according to this method.

Federal Republic of Germany DE-OS 1,703,507 corresponding to U.S. Pat. No. 3,620,167 discloses a subcaliber, fin-stabilized discarding sabot projectile in which the sabot includes a sealing coating of vulcanized rubber synthetic or of caoutchouc (natural rubber) which is applied to the rear gas pressure receiving surface. For the application and vulcanization of the sealing covering, the discarding sabot projectile is placed into a vulcanizing tool provided with an appropriate injection mold. The injection mold leaves a thin circular disc shaped cavity at the rear gas pressure receiving surface of the sabot for the heated sealing material which is injected in liquid form and, when the liquid material is injected, seals the rear outer circumference of the sabot and the projectile body over its circumference at an appropriate distance (e.g. 3 to 8 mm) from the rear gas pressure receiving surface of the sabot. The sealing coating, on the one hand, fixes or secures the segments of the sabot in their rear region and seals the parting grooves of the sabot segments against the gas pressure of the propelling charge gases.

The liquid sealing mass is injected into the injection mold under a high pressure of, for example 1000 to 1500 bar, usually through a laterally disposed fill opening. Thereafter, the discarding sabot projectile remains in the injection mold or in the vulcanizing tool for a period of about 10 to 15 minutes at the appropriate temperature of, e.g., 150° C. to completely vulcanize, i.e., to solidify, the rubber substance.

Since a seal of the contact faces of the individual elements (discarding sabot segments, projectile body, injection mold components) can practically never be realized one hundred percent because of the permitted or unavoidable dimensional tolerances, it may happen during injection of the rubber mass that the liquid material, which is injected at high pressure, penetrates in an uncontrolled manner into the possibly existing thin gaps between the components and becomes visible as a thin rubber skin (e.g. of a thickness less than 0.1 mm) when the discarding sabot projectile is removed from the vulcanizing tool. This skin can easily be pulled off and removed in the outer regions, i.e., in the areas of contact between the injection mold and the outer circumference of the projectile or the outer circumference of the discarding sabot. However, this is not possible in the inner cylindrical annular gap or annulus between the sabot segments and the projectile body. Since the liquid material may have penetrated to irregular depths, depending on the width of the gap and the injection pressure, this may have disadvantageous effects with respect to true dimensions and in connection with the release of the discarding sabot segments from the projectile body after firing (or, more precisely, when the projectile leaves the muzzle of the gun barrel), resulting in irregular release of the sabot segments and a reduced hit accuracy.

SUMMARY OF THE INVENTION

It is therefore the object of the invention to provide measures for preventing the penetration of sealing material into the rear contact gap or annulus between the sabot and the projectile body, and a projectile body produced by these measures which does not exhibit any disadvantageous adhesions in the region of the rear annular gap between the sabot and the projectile body and thus permits the expectation of improved hit accuracy.

The above object is achieved according to the invention by a method of producing a discarding propelling cage sabot projectile of the above discussed type which method includes the steps of fastening the sabot segments to the projectile body to form a propelling cage sabot which is positioned at its intended rearmost position along the projectile body and held in place by a form locking connection, placing the projectile body with the connected sabot into a vulcanizing tool including an injection mold, sealing the rear gas pressure receiving surface of the sabot and the rear of the interior annulus between the sabot and the circumference of the projectile body by spraying a thin coating of rubber onto the rear gas pressure receiving surface of the sabot, and vulcanizing the rubber of the coating and wherein:

subsequent to the step of fastening and prior to the step of placing the discarding sabot projectile into the vulcanizing tool, a sealing means is applied to the circumference of the projectile body adjacent the rear gas pressure receiving surface to seal the rear interior annulus between the sabot and the projectile body.

According to the preferred embodiment of the invention, the step of applying a sealing means includes placing a rubber sealing ring around the projectile body and against the rear gas pressure receiving surface so that the sealing ring is bonded to or vulcanized into the rubber coating during the vulcanization of the rubber coating. Preferably, the rubber sealing ring is formed of the same rubber material as the coating of rubber, has a circular cross-section, and has a normal diameter between 20% and 30% smaller than the outer diameter of the cylindrical portion of the projectile body.

The above object is additionally achieved by a discarding propelling cage sabot projectile formed according to the above method and including a projectile body having an elongated cylindrical portion, form locking means, extending over a region of the length of the cylindrical portion, for engaging a corresponding structure on the inner surface of a propelling cage sabot formed of a plurality of longitudinally extending segment and having a gas pressure receiving surface at its rear, with the sabot surrounding at least the region of the length of the cylindrical portion containing the form locking means and engaging same to secure the axial position of the sabot on the projectile body, and a thin layer of vulcanized rubber molded onto and sealing the gas pressure receiving surface and the adjacent portion of the circumferential surface of the cylindrical portion of the projectile body and sealing the gas pressure receiving surface and the rear of the annulus between the inner surface of the sabot and the circumferential surface of the projectile body; and wherein a sealing ring is disposed around the projectile body beneath the rubber coating and against the gas pressure receiving surface to seal the annulus from the rubber coating material.

Although Federal Republic of Germany DE-OS 2,836,963 corresponding to U.S. Pat. No. 4,444,114 already discloses a discarding sabot projectile in which a sealing ring is employed between the sabot and projectile body, this sealing ring is inserted in the rear region of the sabot into an internal, circumferential annular groove in the sabot segments and serves exclusively to provide a gas seal between the sabot segments and the circumference of the projectile body. The gas seal between the sabot segments themselves, however, is provided by elongate sealing elements which are inserted into appropriate grooves disposed in the abutting faces or parting planes between the individual sabot segments. A uniform sealing covering sprayed or vulcanized onto the rear gas pressure receiving surface of the sabot by means of a special injection mold is not provided here so that neither the problem nor the solution according to the present invention are made obvious by this prior art discarding sabot projectile.

By sealing the inner gap or annulus between the circumference of the projectile body and the rear gas pressure receiving surface of the sabot (i.e., the internal bore for receiving the projectile body) by means of a simple sealing ring, the penetration of liquid soft natural rubber or silicone rubber during injection of the sealing material and at the high vulcanization pressure of about 1500 bar is reliably prevented. The present invention provides a cost-effective way for a one hundred percent seal of the gap without structural changes to the sabot, the projectile body or the injection chamber. Thus it is no longer possible for disadvantageous warping of the sabot and the projectile body to occur. During the vulcanizing process, the sealing ring is very advantageously bonded to the injected sealing material to form a unit.

A discarding sabot projectile produced according to the invention is illustrated in the drawing figures and will be described in greater detail below.

BRIEF SUMMARY OF THE INVENTION

DETAILED DESCRIPTION OF THE PREFERRED EMBODIMENTS

Figure 1:
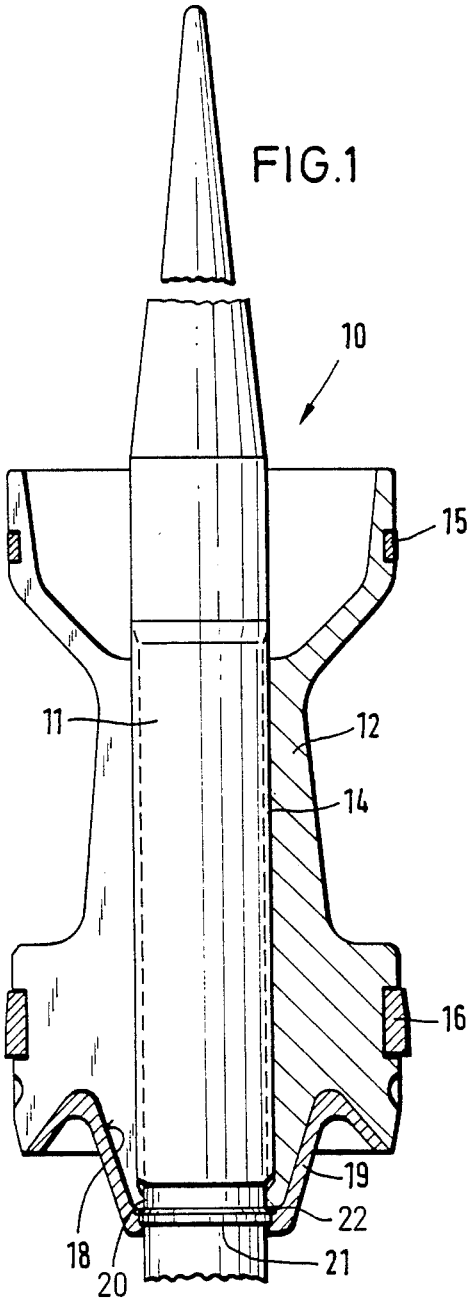
FIG. 1 is a partial longitudinal sectional view of a discarding sabot projectile according to the invention.

Referring now to FIG. 1, there is shown a discarding sabot projectile 10 including a very slender kinetic energy projectile body 11 and a discardable propelling cage sabot 12, i.e. of 105 mm or 120 mm caliber, which in a known and conventional manner is formed of a plurality of longitudinally extending segments. At the end of the kinetic energy projectile body not shown in the drawing, a guide mechanism of fins or a perforated cone is provided in the usual manner to provide fin stabilization.

To transmit the forces generated by the gas pressure, the sabot 12 is connected over a form-locking zone 14, e.g. a group of threaded teeth, in a form-locking manner with the kinetic energy projectile body 11 which, as practice ammunition, is composed, for example, of steel or, as combat ammunition, for example of tungsten material. In order to hold the individual segments of the sabot 12 together on the projectile body 11 and to provide a seal against the inner wall of the gun barrel for the gas pressure, sabot 12 is provided, in a known manner, with a holding or supporting band 15 in the frontal region of its circumferential surface and with a rotating band 16 in the rear region of its circumferential surface. A substantially uniform thin sealing coating 19 of rubber is vulcanized to the rear gas pressure receiving surface 18 of the sabot 12 to seal both the parting or separation grooves between the sabot segments and the annular gap around the circumference of projectile body 11 against the gas pressure generated by the propelling charge gases during firing. To support the individual sabot segments from the rear when they are released from the projectile body 11 after leaving the muzzle of the gun barrel, an annular bead 21( roll-off edge) is provided on the circumference of projectile body 11 immediately behind the form-locking zone 14.

According to the method of the present invention, after fastening the sabot 12 to the projectile body 11, but prior to placing the discarding sabot projectile 10 into a vulcanizing tool for the injected application of the rubber coating 19, the rear end of the annulus or annular gap 20 between the sabot 12 and the circumferential surface of the projectile body 11 is sealed by applying a sealing substance or device to the circumferential surface of the projectile body 11 directly in front of the rear gas pressure receiving surface 18 of the sabot 12. Preferably this sealing substance or device is a sealing ring 22, as shown more clearly in FIG. 2, which is formed of the same material as the coating 19 to be applied and was previously only initially partially vulcanized so that it can subsequently be vulcanized into the coating 19.

Figure 2:
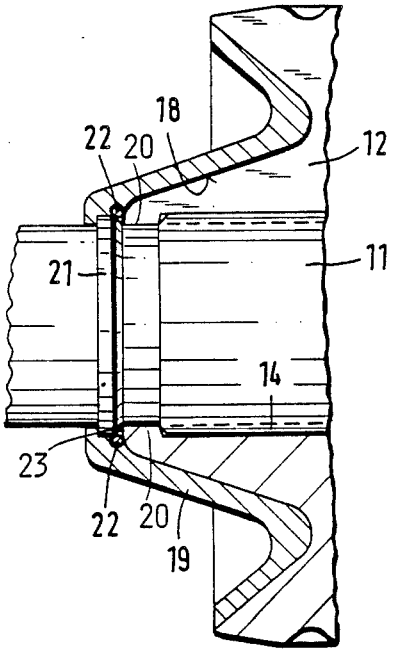
FIG. 2 is an enlarged view of the rear sabot region of FIG. 1.

The enlarged view of FIG. 2 show the arrangement of the sealing ring 22 directly on the circumference of projectile body 11 and in front of and contacting the rear gas pressure receiving surface 18 of the sabot 12. This sealing ring 22 prevents the penetration of liquid rubber into the annulus or cylindrical annular gap 20 between the sabot 12 and the surface of the projectile body 11 in the injection mold or, more precisely, in the vulcanizing tool. During injection of the liquid sealing mass into the injection mold, sealing ring 22 is covered by the sealing mass and is then vulcanized into it.

Sealing ring 22 preferably has a circular cross section since this provides for the best fit in the circumferential groove 23 formed in front of the annular gap 20 by the beveled edge of the bead 21 and the surface 18. However, the sealing ring 22 may also have another suitable cross section, e.g. square, oval, triangular etc. To ensure the seal, the sealing ring 22 preferably has a free (unstretched) normal inner diameter which is 20%–30%, preferably 25%, smaller than the diameter of the projectile body 11 where the ring 22 is located.

When the sabot segments are released from the projectile body 11 after firing, the sealing coating 19 and the sealing ring 22 break open along the parting planes (parting grooves) of the sabot segments, and sealing coating 19 breaks away from the circumferential surface of the projectile body 11.

Figure 3:
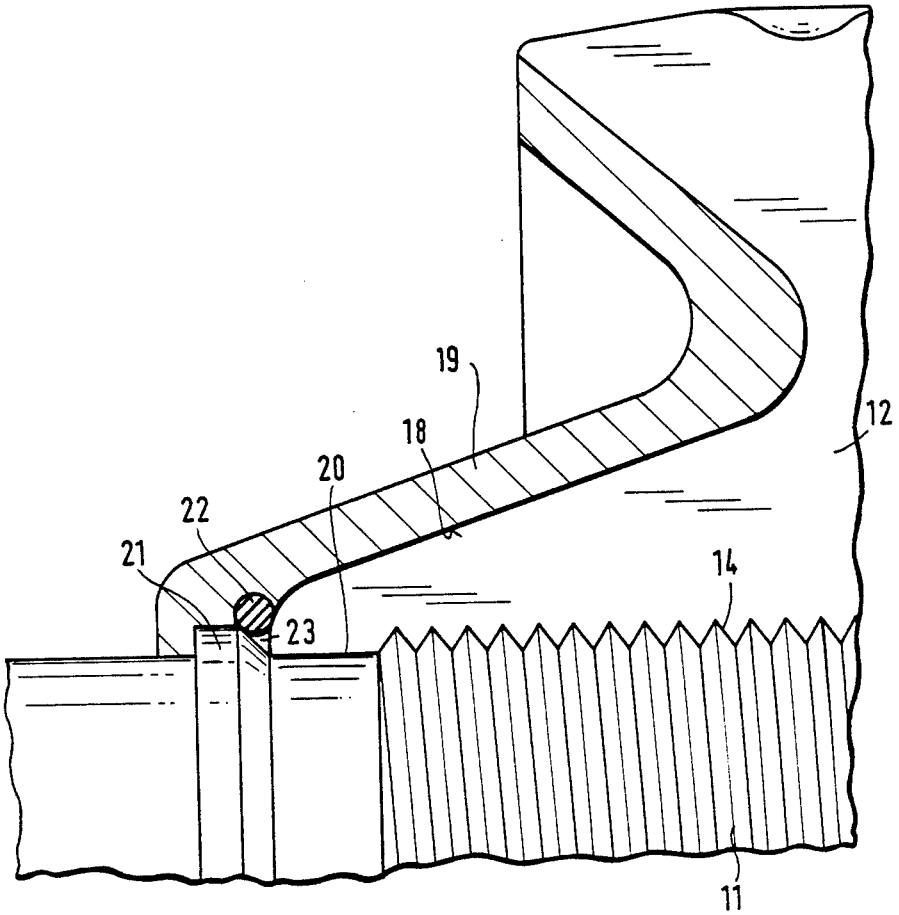
FIG. 3 is an enlarged partial view of the rear sabot region of FIG. 2.

FIG. 3 even more clearly shows the arrangement of the sealing ring 22 (made, for example, of rubber, caoutchouc or an elastic plastic) in the wedge-shaped gap 23 between the annular bead 21 (with its beveled or chamfered front edge) of projectile 11 and the rear end of sabot 12.

Before the sealing coating 19 is attached or, more precisely, vulcanized, sealing ring 22 is inserted into the annular gap 23. When the sealing coating 18 is vulcanized in an appropriate vulcanization machine into which the projectile body il with its attached sabot 12 has been inserted. The liquid vulcanization mass is injected into the vulcanization machine under high pressure and is hardened (vulcanized) at increased temperature.

With the present invention, it is now no longer possible for the liquid caoutchouc to undesirably enter into to the inner cylindrical annular gap 20 formed between the outer circumferential surface of projectile body 11 and the inner circumferential face of the last region of the sabot 12 in the axial region between the form-locking zone 14 (threads) and the annular gap 23. In this way it is ensured that, after firing, the individual sabot segments are released from the projectile body 11 uniformly and simultaneously.

The invention now being fully described, it will be apparent to one of ordinary skill in the art that many changes and modifications can be made thereto without departing from the spirit or scope of the invention as set forth herein.

The present disclosure relates to the subject matter disclosed in German Application P 37 30 370.8 of Sept. 10th, 1987, the entire specification of which is incorporated herein by reference.

What is claimed is:

1. In a method of producing a discarding propelling cage sabot projectile of a type including a projectile body having a cylindrical portion, means disposed on and extending along a region of an outer surface of said cylindrical portion for providing a form locking connection, and a propelling cage sabot formed of a plurality of adjacent longitudinally extending segments which surround at least said region of said outer surface of said cylindrical portion, which engage said means for providing a form locking connection, and which are fastened in place by holding means, and with said propelling cage sabot having a rear surface which acts as a gas pressure receiving surface during launching of the projectile, and wherein said method includes the steps of fastening the plurality of segments to the projectile body to form the propelling cage sabot which is positioned at an intended rearmost position along the projectile body and held in place by the form locking connection, sealing the gas pressure receiving surface and an interior annulus formed between the sabot and the outer surface of the projectile body at the rear gas pressure receiving surface by spraying a thin coating of rubber, under pressure, onto the rear gas pressure receiving surface of the sabot, and vulcanizing the rubber of said coating; the improvement comprising the following step:

subsequent to said step of fastening and prior to said step of sealing, applying a sealing means to the outer surface of the projectile body adjacent said rear gas pressure receiving surface to seal a rear end of said interior annulus between the sabot and the projectile body.

2. A method as defined in claim 1 wherein said step of applying a sealing means includes placing a rubber sealing ring around said projectile body and against said rear gas pressure receiving surface.

3. A method as defined in claim 2 wherein the sealing ring is bonded to the rubber coating during the vulcanization of the rubber coating.

4. A method as defined in claim 3 wherein the rubber material of the sealing ring is partially vulcanized when the sealing ring is applied; and wherein the sealing ring is further vulcanized into said coating during said step of vulcanizing.

5. A method as defined in claim 4 wherein the rubber sealing ring is formed of the same rubber material as the coating of rubber.

6. A method as defined in claim 3 wherein the sealing ring has a circular cross-section.

7. A method as defined in claim 2 wherein the sealing ring has a normal diameter between 20% and 30% smaller than the outer diameter of the cylindrical portion of the projectile body.

* * * * *